US011753214B2

(12) United States Patent
Buchovecky et al.

(10) Patent No.: US 11,753,214 B2
(45) Date of Patent: Sep. 12, 2023

(54) CLOSURE, COMBINATION CONTAINER AND CLOSURE SYSTEM, AND METHOD OF USING THE SAME

(71) Applicant: SAINT-GOBAIN PERFORMANCE PLASTICS CORPORATION, Solon, OH (US)

(72) Inventors: Eric Buchovecky, Harvard, MA (US); Michael J. McCabe, Corona, CA (US); Hy B. Nguyen, Upland, CA (US); Robert Steven Murphy, Evanston, IL (US); Kevin Nakasone, Torrance, CA (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 30 days.

(21) Appl. No.: 17/443,905

(22) Filed: Jul. 28, 2021

(65) Prior Publication Data

US 2022/0033147 A1 Feb. 3, 2022

Related U.S. Application Data

(60) Provisional application No. 63/058,269, filed on Jul. 29, 2020.

(51) Int. Cl.
*B65D 41/04* (2006.01)

(52) U.S. Cl.
CPC ..... *B65D 41/0421* (2013.01); *B65D 2251/20* (2013.01)

(58) Field of Classification Search
CPC ..... B65D 41/0421; B65D 2251/20; B65D 41/0407; B65D 41/04
See application file for complete search history.

(56) References Cited

U.S. PATENT DOCUMENTS

| | | | |
|---|---|---|---|
| 3,232,470 | A | 2/1966 | Gibson |
| 3,370,732 | A | 2/1968 | La Vange |
| 4,708,255 | A | 11/1987 | Thompson |
| 5,143,219 | A | 9/1992 | Yates, Jr. |
| 5,161,707 | A | 11/1992 | Dutt et al. |

(Continued)

FOREIGN PATENT DOCUMENTS

| | | | |
|---|---|---|---|
| CN | 208278612 | U | 12/2018 |
| JP | 2017030809 | A | 2/2017 |

(Continued)

OTHER PUBLICATIONS

International Search Report and Written Opinion for PCT/US2021/071035, dated Nov. 8, 2021, 11 pages.

*Primary Examiner* — Shawn M Braden
(74) *Attorney, Agent, or Firm* — Abel Schillinger, LLP; Chi Suk Kim

(57) ABSTRACT

The present application is directed to a closure for a container having a generally annular neck defining a container opening having a central axis, the closure including: an annular top wall having opposed inner and outer surfaces; a generally annular skirt extending downwardly from the inner surface of the top wall, the generally annular skirt having opposed outer and inner surfaces; and an elastic annular seal member extending downwardly from an inner surface of the top wall, the annular seal member adapted to engage the inner surface of the neck of the container.

20 Claims, 4 Drawing Sheets

(56) References Cited

U.S. PATENT DOCUMENTS

| | | | | |
|---|---|---|---|---|
| 5,875,918 | A | 3/1999 | Sheffler et al. | |
| 7,886,779 | B2 | 2/2011 | Smith | |
| 2002/0175172 | A1 | 11/2002 | Diesterbeck | |
| 2003/0146185 | A1* | 8/2003 | Francois | B65D 41/0421 215/354 |
| 2005/0194343 | A1 | 9/2005 | Sprishen | |
| 2011/0186534 | A1 | 8/2011 | Nilsson | |
| 2013/0301959 | A1 | 11/2013 | Tom et al. | |
| 2014/0231427 | A1* | 8/2014 | Botet | B65D 77/0486 220/62.21 |
| 2015/0078685 | A1 | 3/2015 | Tom et al. | |
| 2015/0102033 | A1* | 4/2015 | Banovic | B65D 1/0246 220/288 |
| 2017/0225851 | A1* | 8/2017 | Wada | B65D 41/0421 |
| 2018/0148231 | A1 | 5/2018 | Pennington et al. | |
| 2020/0031531 | A1* | 1/2020 | Hanan | B65D 41/3442 |
| 2021/0206545 | A1* | 7/2021 | Krautkramer | B65D 51/1661 |
| 2022/0119165 | A1* | 4/2022 | Hanan | B65D 41/3495 |

FOREIGN PATENT DOCUMENTS

| | | | |
|---|---|---|---|
| KR | 20160088139 | A | 7/2016 |
| WO | 2022027051 | A1 | 2/2022 |

* cited by examiner

CLOSURE, COMBINATION CONTAINER AND CLOSURE SYSTEM, AND METHOD OF USING THE SAME

CROSS-REFERENCE TO RELATED APPLICATION(S)

This application claims priority under 35 U.S.C. § 119(e) to U.S. Provisional Application No. 63/058,269, entitled "CLOSURE, COMBINATION CONTAINER AND CLOSURE SYSTEM, AND METHOD OF USING THE SAME," by Eric BUCHOVECKY et al., filed Jul. 29, 2020, which is assigned to the current assignee hereof and incorporated herein by reference in its entirety.

FIELD OF THE DISCLOSURE

The present disclosure relates to closures, and more particularly to, closures for closing an opening in a container to form a seal without the use of a separate liner.

RELATED ART

Closures can be used to close or seal an opening in containers or vessels. Closures having separate liners used to seal the interface between the opening of the container and the closure are generally known. These closures generally operate by compressing the liner between a top edge of a neck of the container and the top wall of the closure. However, current designs of closures have many drawbacks. For example, current designs of closures may not provide adequate seal integrity over time. Further, in certain applications, current designs of closures may not adequately maintain sterilization of a product inside the container. Lastly, in certain applications, current designs of closures may require tools to separate the closure and the container to open the container, increasing the burden of use and cost. Therefore, improvements in closures are needed, particularly in enabling the closures to achieve optimal sealing engagement with the container while allowing improved ease of use.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single embodiment is described herein, more than one embodiment may be used in place of a single embodiment. Similarly, where more than one embodiment is described herein, a single embodiment may be substituted for that more than one embodiment.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the container and closure sealing arts.

The following disclosure describes closures adapted to achieve substantial seal engagement to a container to ensure an adequate seal in assembling a closure and container. The concepts are better understood in view of the embodiments described below that illustrate and do not limit the scope of the present invention.

Figure 1A:
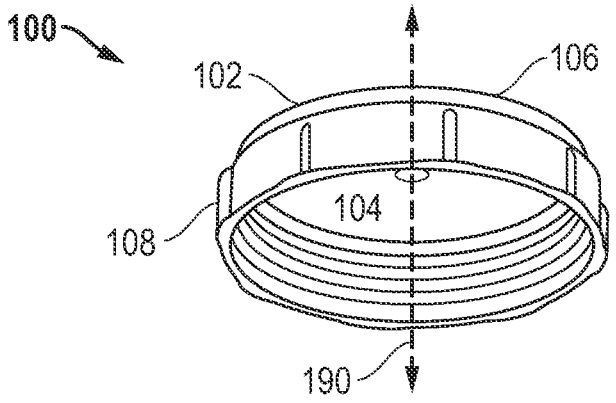
FIG. 1A illustrates a side perspective view of a closure according to a number of embodiments of the present disclosure.

For purposes of illustration, FIG. 1A illustrates a side perspective view of a closure 100 according to a number of embodiments of the present disclosure. For purposes of illustration, the closure 100 may be oriented down a central axis 190. As best illustrated in FIG. 1, the closure 100 may include a top wall 102 having opposed inner and outer surfaces 104, 106 respectively.

According to certain embodiments, the top wall 102 of the closure 100 may further include an outer edge 108. In a number of embodiments, the top wall 102 of the closure 100 may be an annular or generally circular cross-section. In a number of variations, the top wall 102 of the closure 100 may have a polygonal, oval, circular, semi-circular, or substantially circular cross-section. In a number of embodiments, the top wall 102 of the closure 100 may be generally flat.

Figure 1B:
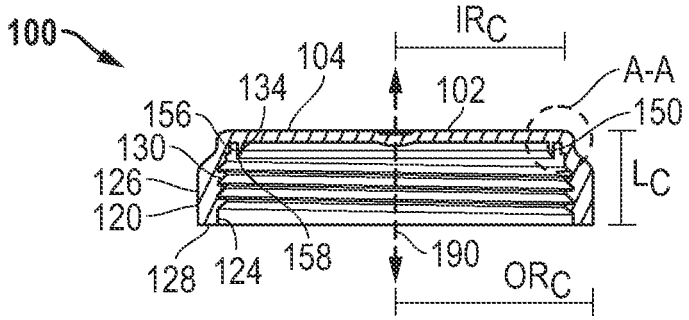
FIG. 1B illustrates a cross-sectional view of a closure taken on a line parallel to the central axis according to a number of embodiments of the present disclosure.

FIG. 1B illustrates a cross-sectional view of a closure 100 taken on a line parallel to the central axis according to a number of embodiments of the present disclosure. As shown in FIG. 1B, the closure 100 may further include a generally annular skirt 120 extending downwardly from the inner surface 104 of the top wall 102. The generally annular skirt 120 may include opposed inner and outer surfaces 124, 126 respectively with an open bottom side. The generally annular skirt 120 may further include a bottom edge 128. The generally annular skirt 120 of the closure 100 may further include threadings 130 on the inner surface 124.

As further illustrated in FIG. 1B, the closure 100 may further include an elastic annular seal member 150 extending downwardly from an inner surface 104 of the top wall 102. The elastic annular seal member 150 may include opposed inner and outer surfaces 154, 156 respectively. The elastic annular seal member 150 may include an apex 158 joining the inner and outer surfaces 154, 156. The outer surface 156 of the elastic seal member 150 may extend downward from the inner surface 104 of the top wall 102 in a direction generally parallel to the central axis 190. The inner surface 154 of the elastic seal member 150 may extend downward from the inner surface 104 of the top wall 102. The elastic annular seal member 150 may form a gap surface 145 between the outer surface 156 of the elastic annular seal member 150 and the inner surface 124 of the generally annular skirt 120.

In a number of embodiments, the closure 100 may have a particular outer radius $OR_C$. For purposes of embodiments described herein and as shown in FIG. 1B, the outer radius $OR_C$ of the closure 100 is the distance from the central axis 190 to the outer surface 126 of the skirt 120. According to a certain embodiment, the outer radius $OR_C$ of the closure 100 may be at least about 1 mm, such as at least about 10 mm or at least about 20 mm or at least about 30 mm or at least about 40 mm or even at least about 50 mm. According to still other embodiments, the outer radius $OR_C$ of the closure 100 may be not greater than about 200 mm, such as, not greater than about 50 mm or even not greater than about 25 mm. It will be appreciated that the outer radius $OR_C$ of the closure 100 may be within a range between any of the minimum and maximum values noted above. It will be further appreciated that the outer radius $OR_C$ of the closure 100 may be any value between any of the minimum and maximum values noted above.

In a number of embodiments, the closure 100 may have a particular inner radius $IR_C$. For purposes of embodiments described herein and as shown in FIG. 1B, the inner radius $IR_C$ of the closure 100 is the distance from the central axis 190 to the inner surface 124 of the skirt 120. According to a certain embodiment, the inner radius $IR_C$ of the closure 100 may be at least about 1 mm, such as at least about 10 mm or at least about 20 mm or at least about 30 mm or at least about 40 mm or even at least about 50 mm. According to still other embodiments, the inner radius $IR_C$ of the closure 100 may be not greater than about 200 mm, such as, not greater than about 50 mm or even not greater than about 25 mm. It will be appreciated that the inner radius $IR_C$ of the closure 100 may be within a range between any of the minimum and maximum values noted above. It will be further appreciated that the inner radius $IR_C$ of the closure 100 may be any value between any of the minimum and maximum values noted above.

In a number of embodiments, the closure 100 can have a length $L_C$. For purposes of embodiments described herein and as shown in FIG. 1B, the length $L_C$ of the closure 100 is the distance from the outer surface 106 of the top wall 102 to the bottom edge 128 of the skirt 120. According to a certain embodiment, the length $L_C$ of the closure 100 may be at least about 1 mm, such as at least about 10 mm or at least about 30 mm or at least about 40 mm or at least about 50 mm or even at least about 60 mm. According to still other embodiments, the length $L_C$ of the closure 100 may be not greater than about 100 mm, such as, not greater than about 50 mm or even not greater than about 25 mm. It will be appreciated that the length $L_C$ of the closure 100 may be within a range between any of the minimum and maximum values noted above. It will be further appreciated that the length $L_C$ of the closure 100 may be any value between any of the minimum and maximum values noted above.

Figure 1C:
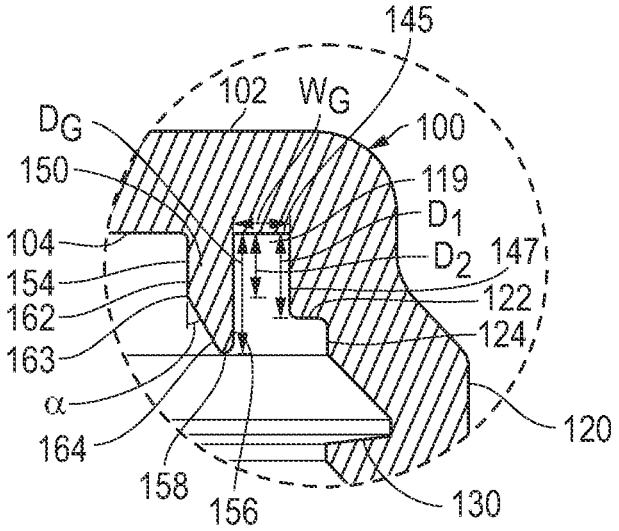
FIG. 1C illustrates a close-up view of a closure taken at circle A-A in FIG. 1B according to a number of embodiments of the present disclosure.

FIG. 1C illustrates a close-up view taken at circle A-A of the closure 100 in FIG. 1B according to a number of embodiments of the present disclosure. As shown in FIG. 1C, the inner surface 154 of the elastic seal member 150 may include a first section 162 and a second section 164 that meet at a bridge section 163. The first section 162 of the inner surface 154 of the elastic seal member 150 may extend downward from the inner surface 104 of the top wall 102 in a direction generally parallel to the central axis 190. The second section 164 of the inner surface 154 of the elastic seal member 150 may be tapered outwardly toward the outer surface 156 to meet the outer surface 156 at the apex 158.

The first section 162 of the inner surface 154 of the elastic seal member 150 may meet the second section 164 at the bridge section 163 to form an angle $\alpha$ with respect to a direction parallel to the central axis 190. By way of a non-limiting embodiment, the angle $\alpha$ between the first section 162 and the second section 164 can be at least 0.1°, such as at least 2°, at least 4°, at least 5°, or even at least 10°. In another embodiment, the angle $\alpha$ can be no greater than 90°, such as no greater than 75°, no greater than 60°, no greater than 45°, no greater than 20°, or even no greater than 15°. In still another embodiment, the angle $\alpha$ can be no less than or equal to 30°. It will be appreciated that the angle $\alpha$ may be within a range between any of the minimum and maximum values noted above. It will be further appreciated that the angle $\alpha$ may be any value between any of the minimum and maximum values noted above.

In a number of embodiments, the elastic seal member 150 of the closure 100 may have a particular depth $D_G$. For purposes of embodiments described herein and as shown in FIG. 1B, the depth $D_G$ of the elastic seal member 150 of the closure 100 is the distance from inner surface 104 of the annular top wall 102 of the closure 100 to the apex 158 of the elastic seal member 150. According to a certain embodiment, the depth $D_G$ of the elastic seal member 150 of the closure 100 may be at least about 0.01 mm, such as at least about 0.1 mm or at least about 1 mm or at least about 3 mm or at least about 5 mm or even at least about 10 mm. According to still other embodiments, the depth $D_G$ of the elastic seal member 150 of the closure 100 may be not greater than about 20 mm, such as, not greater than about 10 mm or even not greater than about 5 mm. It will be appreciated that the depth $D_G$ of the elastic seal member 150 of the closure 100 may be within a range between any of the minimum and maximum values noted above. It will be further appreciated that the depth $D_G$ of the elastic seal member 150 of the closure 100 may be any value between any of the minimum and maximum values noted above. For example, the depth $D_G$ of the elastic seal member 150 of the closure 100 may be 3.6 mm.

In a number of embodiments, the elastic seal member 150 and the generally annular skirt 120 of the closure 100 may form a groove 119 having a width $W_G$. For purposes of embodiments described herein and as shown in FIG. 1C, the width $W_G$ of the groove 119 of closure 100 is the distance from the outer surface 156 of the elastic seal member 150 to an innermost surface 147 of the inner surface 124 of the skirt 120. The gap surface 145 may span the width $W_G$ of the groove 119 of closure 100. According to a certain embodiment, the width $W_G$ of the groove 119 of the closure 100 may be at least about 0.01 mm, such as at least about 0.1 mm or at least about 1 mm or at least about 2 mm or at least about 5 mm or even at least about 10 mm. According to still other embodiments, the width $W_G$ of the groove 119 of the closure 100 may be not greater than about 15 mm, such as, not greater than about 10 mm or even not greater than about 5 mm. It will be appreciated that the width $W_G$ of the groove 119 of the closure 100 may be within a range between any of the minimum and maximum values noted above. It will be further appreciated that the width $W_G$ of the groove 119 of the closure 100 may be any value between any of the minimum and maximum values noted above.

Still referring to FIG. 1C, in a number of embodiments, the generally annular skirt 120 of the closure 100 may include at least one step 122. The at least one step 122 may include a plurality of steps. The at least one step 122 may be located on the inner surface 124 of the generally annular skirt 120. In a number of embodiments, the at least one step 122 may define a distance, $D_1$, from the inner surface 104 of the annular top wall 102 of the closure 100 and the end of the first section 162 (i.e., the bridge section 163) of the inner surface 154 of the elastic seal member 150 may define a distance, $D_2$, from the inner surface 104 of the annular top wall 102 of the closure 100. In a number of embodiments, $D_1 \approx D_2$, such as $D_1 \approx 0.9\ D_2$. In a number of embodiments, $D_1 \leq 0.9\ D_2$, such as $D_1 \leq D_2$, $D_1 \leq 1.10\ D_2$, $D_1 \leq 1.15\ D_2$, $D_1 \leq 1.20\ D_2$, or $D_1 \leq 1.25\ D_2$. In a number of embodiments, $D_2 \leq 1.01\ D_1$, such as $D_2 \leq 1.05\ D_1$, $D_2 \leq 1.10\ D_1$, $D_2 \leq 1.15\ D_1$, $D_2 \leq 1.20\ D_1$, or $D_2 \leq 1.25\ D_1$.

Still referring to FIG. 1C, in a number of embodiments, the distance, $D_1$, from the inner surface 104 of the annular top wall 102 of the closure 100 and the depth $D_G$ of the elastic seal member 150 of the closure 100 may be in a ratio. In a number of embodiments, $D_1 \approx D_G$, such as $D_1 \approx 0.9\ D_G$. In a number of embodiments, $D_1 \leq 0.9\ D_G$, such as $D_1 \leq D_G$, $D_1 \leq 1.10\ D_G$, $D_1 \leq 1.15\ D_G$, $D_1 \leq 1.20\ D_G$, or $D_1 \leq 1.25\ D_G$. In a number of embodiments, $D_G \leq 1.01\ D_1$, such as $D_G \leq 1.05\ D_1$, $D_G \leq 1.10\ D_1$, $D_G \leq 1.15\ D_1$, $D_G \leq 1.20\ D_1$, or $D_G \leq 1.25\ D_1$.

Figure 1D:
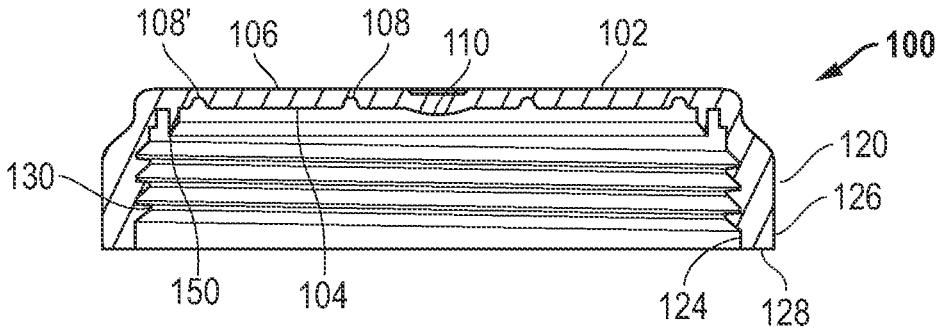
FIG. 1D illustrates a cross-sectional view of a closure taken on a line parallel to the central axis according to a number of embodiments of the present disclosure.
Figure 1E:
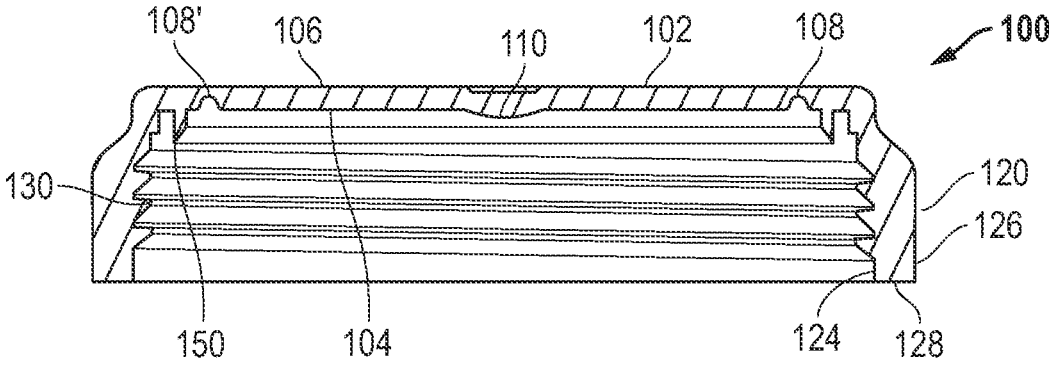
FIG. 1E illustrates a cross-sectional view of a closure taken on a line parallel to the central axis according to a number of embodiments of the present disclosure.

FIGS. 1D and 1E illustrate cross-sectional views of a closure taken on a line parallel to the central axis according to a number of embodiments of the present disclosure. As shown in FIGS. 1D and 1E, the inner surface 104 of the top wall 102 may include at least one protrusion 110. The protrusion 110 may be located in a central portion or may even bisect the closure 100. The protrusion 110 may have a polygonal, oval, circular, semi-circular, or substantially circular cross-section. Further, the inner surface 104 of the top wall 102 may include at least one groove 108, 108'. The groove 108 may have a polygonal, oval, circular, semi-circular, or substantially circular cross-section. The groove 108 and/or protrusion 110 may aid in providing sealing between the closure 100 and a container as discussed in more detail below.

Figure 2A:
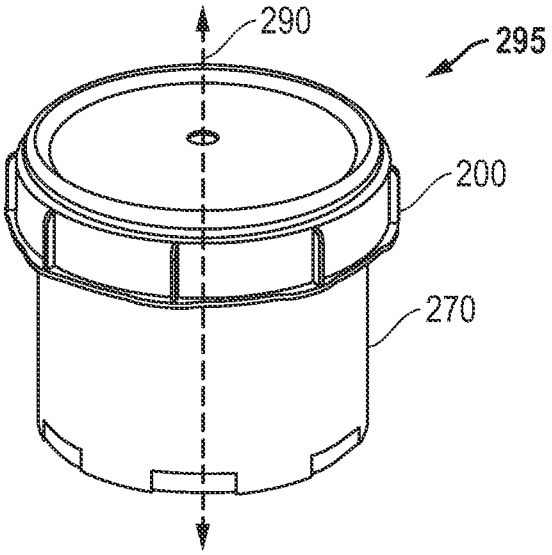
FIG. 2A illustrates a side view of a closure and container system in accordance with alternative embodiments.

FIG. 2A illustrates a side view of a closure and container system in 295 in accordance with alternative embodiments. The closure and container system 295 may further be oriented down a central axis 290. As illustrated in FIG. 2A, the closure and container system 295 may include a closure 200. It will be appreciated that closure 200 may include any of the characteristics or features of closures described herein. The closure and container system 295 may further include a container 270.

Figure 2B:
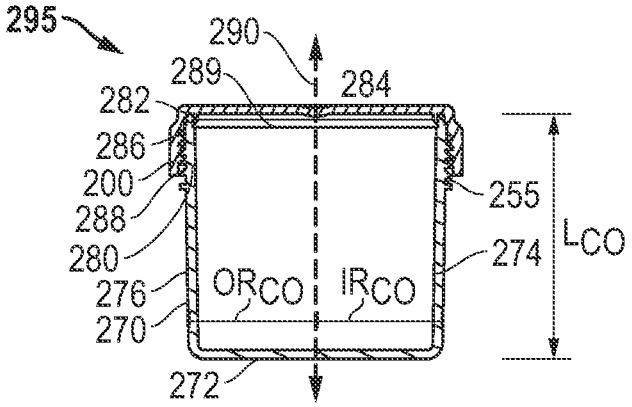
FIG. 2B illustrates a cross-sectional view of a container system taken on a line parallel to the central axis according to a number of embodiments of the present disclosure.

FIG. 2B illustrates a cross-sectional view of a closure and container system 295 taken on a line parallel to the central axis according to a number of embodiments of the present disclosure. As shown in FIG. 2B, the container 270 may include a base 272, an inner surface 274, and an outer surface 276. The container 270 may further include a generally annular neck 280. The neck 280 may have a top edge 282. The top edge 282 may be annular. The neck 280 may further include an inner surface 284 and an outer surface 286. The neck 280 may include threadings 288 located on the outer surface 286. In a number of embodiments, the closure 200 may be intended to be sealingly engaged with the container 270 to "close" the container 270 within the closure and container system 295 and place the system in a "closed position." The neck 280 may define an opening 289 of the container 270. In a number of embodiments, the opening 289 of the container 270 may be an annular or generally circular cross-section. In a number of variations, the opening 289 of the container 270 may have a polygonal, oval, circular, semi-circular, or substantially circular cross-section.

As best illustrated in FIG. 2B, in an embodiment, the closure 200 may include a locking mechanism 255. The locking mechanism 255 may be adapted to lock and seal the closure 200 to the container 270. The locking mechanism 255 may be engaged physically through manual, mechanical, or automatic means to lock and seal the closure 200 to the container 270. In an embodiment, the locking mechanism 255 may include a latch adapted to contact and seal to a groove or projection on the closure 200 or the container 270. In an embodiment, the locking mechanism 255 may include a catch adapted to contact and seal to a groove or projection on the closure 200 or the container 270. The locking mechanism 255 may include screw threads or threadings, bolts, battens, buckle, clamp, clip, flange, frog, grommet, hook-and-eye, latch, peg, nail, rivet, screw anchor, snap fastener, stitch, threaded fastener, tie, toggle bolt, wedge anchor, pin, groove and stop, nut and bolt, nut and screw, latch, handle, locking nut, tie rivet, or may be coupled a different way between the closure 200 to the container 270.

In a number of embodiments, the container 270 may have a particular outer radius $OR_{CO}$. For purposes of embodiments described herein and as shown in FIG. 2B, the outer radius $OR_{CO}$ of the container 270 is the distance from the central axis 290 to the outermost portion of the outer surface 286 of the neck 280. According to a certain embodiment, the outer radius $OR_{CO}$ of the container 270 may be at least about 1 mm, such as at least about 10 mm or at least about 20 mm or at least about 30 mm or at least about 40 mm or even at least about 50 mm. According to still other embodiments, the outer radius $OR_{CO}$ of the container 270 may be not greater than about 200 mm, such as, not greater than about 50 mm or even not greater than about 25 mm. It will be appreciated that the outer radius $OR_{CO}$ of the container 270 may be within a range between any of the minimum and maximum values noted above. It will be further appreciated that the outer radius $OR_{CO}$ of the container 270 may be any value between any of the minimum and maximum values noted above.

In a number of embodiments, the container 270 may have a particular inner radius $IR_{CO}$. For purposes of embodiments described herein and as shown in FIG. 2B, the inner radius $IR_{CO}$ of the container 270 is the distance from the central axis 290 to the innermost portion of the inner surface 284 of the neck 280. According to a certain embodiment, the inner radius $IR_{CO}$ of the container 270 may be at least about 1 mm, such as at least about 10 mm or at least about 20 mm or at least about 30 mm or at least about 40 mm or even at least about 50 mm. According to still other embodiments, the inner radius $IR_{CO}$ of the container 270 may be not greater than about 200 mm, such as, not greater than about 50 mm or even not greater than about 25 mm. It will be appreciated that the inner radius $IR_{CO}$ of the container 270 may be within a range between any of the minimum and maximum values noted above. It will be further appreciated that the inner radius $OR_{CO}$ of the container 270 may be any value between any of the minimum and maximum values noted above.

In a number of embodiments, the container 270 can have a length $L_{CO}$. For purposes of embodiments described herein and as shown in FIG. 2B, the length $L_{CO}$ of the container 270 is the distance from the top edge 282 of the neck 280 to the base 272 of the container 270. According to a certain embodiment, the length $L_{CO}$ of the container 270 may be at least about 1 mm, such as at least about 10 mm or at least about 30 mm or at least about 40 mm or at least about 50 mm or even at least about 60 mm. According to still other embodiments, the length $L_{CO}$ of the container 270 may be not greater than about 200 mm, such as, not greater than about 50 mm or even not greater than about 25 mm. It will be appreciated that the length $L_{CO}$ of the container 270 may be within a range between any of the minimum and maximum values noted above. It will be further appreciated that the length $L_{CO}$ of the container 270 may be any value between any of the minimum and maximum values noted above.

Figure 2C:
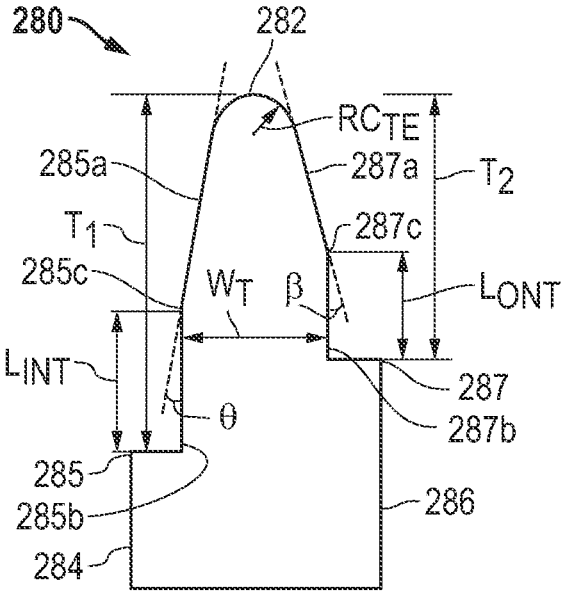
FIG. 2C illustrates a close-up view of the neck of the container system taken at circle B-B in FIG. 2B according to a number of embodiments of the present disclosure.

FIG. 2C illustrates a close-up view of the neck 280 of the container taken at circle B-B in FIG. 2B according to a number of embodiments of the present disclosure. As stated above, the neck 280 may have a top edge 282. The top edge 282 may be annular. The neck 280 may further include an inner surface 284 and an outer surface 286.

In a number of embodiments, the inner surface 284 of the neck 280 may include at least one step 285. The at least one step 285 may include a plurality of steps. In a number of embodiments, the outer surface 286 of the neck 280 may include at least one step 287. The at least one step 287 may include a plurality of steps. In a number of embodiments, the at least one step 285 on the inner surface 284 of the neck 280 may define a distance, $T_1$, from the top edge 282 of the neck 280 to the at least one step 285 of the inner surface 284 of the neck 280. Further, in a number of embodiments, the at least one step 287 on the outer surface 286 of the neck 280 may define a distance, $T_2$, from the top edge 282 of the neck 280 to the at least one step 287 of the outer surface 286 of the neck 280. In a number of embodiments, $T_1 \approx T_2$. In a number of embodiments, $T_1 \geq 1.01\ T_2$, such as $T_1 \geq 1.05\ T_2$, $T_1 \geq 1.10\ T_2$, $T_1 \geq 1.15\ T_2$, $T_1 \geq 1.20\ T_2$, or $T_1 \geq 1.25\ T_2$.

Still referring to FIG. 2C, in a number of embodiments, the neck 280 of the container 270 may be rounded above the step 285 in the inner surface 284 of the neck 280. As used herein "rounded" may be defined as having an arcuate portion along at least a portion of its surface when taken in cross-section parallel to the central axis 290. In a number of embodiments, the rounded neck 280 may happen at the top edge 282 and may have a radius of curvature $RC_{TE}$. In a number of embodiments, the rounded neck 280 may have a radius of curvature in the range of 0.05 mm to 7 mm.

In a number of embodiments, the inner surface 284 of the neck 280 may be tapered inwardly away from the top edge 282 above the step 285 in the inner surface 284 to form a tapered section 285*a* and a non-tapered section 285*b*. The bridge 285*c* between the tapered section 285*a* and the non-tapered section 285*b* of the inner surface 284 of the neck 280 may form an angle θ with respect to a direction parallel to the central axis 290. By way of a non-limiting embodiment, the angle θ between the tapered section 285*a* and the non-tapered section 285*b* can be at least 0.1°, such as at least 2°, at least 4°, at least 5°, or even at least 10°. In another embodiment, the angle θ can be no greater than 90°, such as no greater than 75°, no greater than 60°, no greater than 45°, no greater than 20°, or even no greater than 15°. In still another embodiment, the angle α can be no less than or equal to 30°. It will be appreciated that the angle θ may be within a range between any of the minimum and maximum values noted above. It will be further appreciated that the angle θ may be any value between any of the minimum and maximum values noted above.

In a number of embodiments, the non-tapered section 285*b* of the inner surface 284 of the neck 280 can have a length $L_{INT}$. For purposes of embodiments described herein and as shown in FIG. 2C, the length $L_{INT}$ of the non-tapered section 285*b* of the inner surface 284 of the neck is the distance from the step 285 on the inner surface 284 of the neck 280 to the bridge 285*c* between the tapered section 285*a* and the non-tapered section 285*b* of the inner surface 284 of the neck 280. According to a certain embodiment, the length $L_{INT}$ of the non-tapered section 285*b* may be at least about 0.01 mm, such as at least about 0.1 mm or at least about 1 mm or at least about 2 mm or at least about 5 mm or even at least about 10 mm. According to still other embodiments, the length $L_{INT}$ of the non-tapered section 285*b* may be not greater than about 20 mm, such as, not greater than about 10 mm or even not greater than about 5 mm. It will be appreciated that the length $L_{INT}$ of the non-tapered section 285*b* may be within a range between any of the minimum and maximum values noted above. It will be further appreciated that the length $L_{INT}$ of the non-tapered section 285*b* may be any value between any of the minimum and maximum values noted above.

Still referring to FIG. 2C, in a number of embodiments, the neck 280 of the container 270 may be rounded above the step 287 in the outer surface 286 of the neck 280. In a number of embodiments, the outer surface 286 of the neck 280 may be tapered outwardly away from the top edge 282 above the step 287 of the outer surface 286 to form a tapered section 287*a* and a non-tapered section 287*b*. The bridge 287*c* between the tapered section 287*a* and the non-tapered section 287*b* of the outer surface 286 of the neck 280 may form an angle β with respect to a direction parallel to the central axis 290. By way of a non-limiting embodiment, the angle β between the tapered section 287*a* and the non-tapered section 287*b* can be at least 0.1°, such as at least 2°, at least 4°, at least 5°, or even at least 10°. In another embodiment, the angle β can be no greater than 90°, such as no greater than 75°, no greater than 60°, no greater than 45°, no greater than 20°, or even no greater than 15°. In still another embodiment, the angle α can be no less than or equal to 30°. It will be appreciated that the angle β may be within a range between any of the minimum and maximum values noted above. It will be further appreciated that the angle β may be any value between any of the minimum and maximum values noted above.

In a number of embodiments, the non-tapered section 287*b* of the outer surface 286 of the neck 280 can have a length $L_{ONT}$. For purposes of embodiments described herein and as shown in FIG. 2C, the length $L_{ONT}$ of the non-tapered section 287*b* of the outer surface 286 of the neck is the distance from the step 287 on the outer surface 286 of the neck 280 to the bridge 287*c* between the tapered section 287*a* and the non-tapered section 287*b* of the outer surface 286 of the neck 280. According to a certain embodiment, the length $L_{ONT}$ of the non-tapered section 287*b* may be at least about 0.01 mm, such as at least about 0.1 mm or at least about 1 mm or at least about 2 mm or at least about 5 mm or even at least about 10 mm. According to still other embodiments, the length $L_{ONT}$ of the non-tapered section 287*b* may be not greater than about 20 mm, such as, not greater than about 10 mm or even not greater than about 5 mm. It will be appreciated that the length $L_{ONT}$ of the non-tapered section 287*b* may be within a range between any of the minimum and maximum values noted above. It will be further appreciated that the length $L_{ONT}$ of the non-tapered section 287*b* may be any value between any of the minimum and maximum values noted above.

In a number of embodiments, the neck 280 having a width $W_T$. For purposes of embodiments described herein and as shown in FIG. 2C, of the neck 280 of the container 270 is the distance from the bridge 285*c* on the inner surface 284 to the bridge 287*c* on the outer surface 286 of the neck 280. According to a certain embodiment, the width $W_T$ of the neck 280 may be at least about 0.01 mm, such as at least about 0.1 mm or at least about 1 mm or at least about 2 mm or at least about 5 mm or even at least about 10 mm. According to still other embodiments, the width $W_T$ of the neck 280 may be not greater than about 15 mm, such as, not greater than about 10 mm or even not greater than about 5 mm. It will be appreciated that the width $W_T$ of the neck 280 may be within a range between any of the minimum and maximum values noted above. It will be further appreciated that the width $W_T$ of the neck 280 may be any value between any of the minimum and maximum values noted above.

Figure 3A:
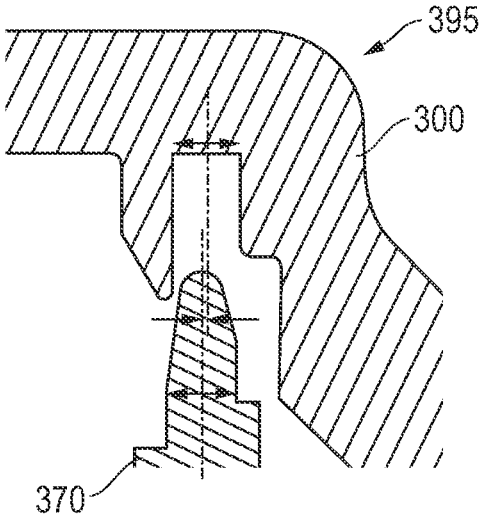
FIG. 3A illustrates a cross-sectional view of a container system in an "open position" taken on a line parallel to the central axis according to a number of embodiments of the present disclosure.
Figure 3B:
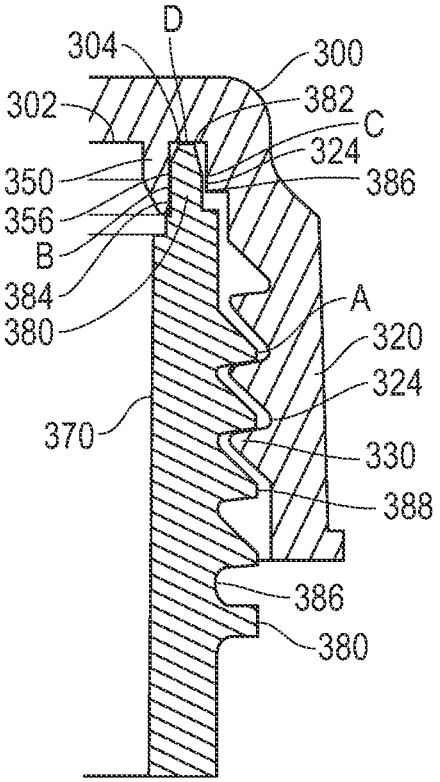
FIG. 3B illustrates a cross-sectional view of a container system in a "closed position" taken on a line parallel to the central axis according to a number of embodiments of the present disclosure.

FIG. 3A illustrates a cross-sectional view of a container system in an "open position" taken on a line parallel to the central axis according to a number of embodiments of the present disclosure. FIG. 3B illustrates a cross-sectional view of a container system in a "closed position" taken on a line parallel to the central axis according to a number of embodiments of the present disclosure. As stated above, the closure 300 may be intended to be sealingly engaged with the container 370 to "close" the container 370 within the closure and container system 395. As shown in FIG. 3B, this may be done through multiple interfaces. A first interface "A" is as the threadings 388 of the outer surface 386 of the neck 380 of the container 370 may couple to threadings 330 on the inner surface 324 of the generally annular skirt 320 of the closure 300. The threadings 388 of the outer surface 386 of the neck 380 of the container 370 may be threadingly engaged to threadings 330 on the inner surface 324 of the generally annular skirt 320 of the closure 300 to act to seal the neck 380 of the container 370 in order to inhibit contents within the container 370 from escaping the closure 300 and container system 395. A second interface "B" is the outer surface 356 of the elastic annular seal member 350 may sealingly engage the inner surface 384 of the neck 380 to form an interference fit between the closure 300 and the container 370. The outer surface 356 of the elastic annular seal member 350 may sealingly engage the inner surface 384 of the neck 380 along 60% of its length, such as along 70% of its length, 80% of its length, 90% of its length, or 100% of its length. A third interface "C" is the inner surface 324 of the skirt 320 may sealingly engage the outer surface 386 of the neck 380 to form an interference fit between the closure 330 and the container 370. Lastly, a fourth interface "D" is the inner surface 304 of the top wall 302 of the closure 300 may sealingly engage the top edge 382 of the neck 380 to form an interference fit between the closure 300 and the container 370. This may provide a liner-less, gasket-less, mechanical seal between the closure 300 and the container 370. The closure and container system 395 may be capable of maintaining sterilization of the contents of the closure and containing system 395 once in a "closed position."

In particular embodiments, the threads or threadings on the closure or container, and combinations thereof can also have a desired number of threads per inch, referred to herein as TPI. The threads or threadings on the closure or container of the embodiments described herein can have a TPI of at least about 1 TPI, at least about 2 TPI, at least about 3 TPI, at least about 4 TPI, at least about 5 TPI, at least about 6 TPI, at least about 7 TPI, at least about 10 TPI, at least about 15 TPI, or even at least about 20 TPI. Further, the threads or threadings on the closure or container may have a threads per inch (TPI) of no greater than about 100 TPI, no greater than about 50 TPI, or even not greater than about 10 TPI. Moreover, the threads or threadings on the closure or container can have a TPI within a range between any of the maximum and minim values described above. In an embodiment, the threads or threadings on the closure or container can form a helical pattern about at their respective surfaces. The threads or threadings 81, 83 on the closure or container can form a helical mating pattern so they may lock to each other.

In particular embodiments, at least one of the closure or the container can be formed of a material including, metal, plastic, glass, or combinations thereof, and particularly pyrex. In certain embodiments, at least one of the closure or the container can be formed of a material including plastic or glass. In an embodiment, at least one of the closure or the container may include a polymer. In an embodiment, at least one of the closure or the container may include a blend of polymers or polymeric polymers including a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based ter-polymer, a polyolefin plastomer, or combinations thereof. In an embodiment, at least one of the closure or the container may include a styrene-based block copolymer such as styrene-butadiene, styrene-isoprene, blends, or mixtures thereof, mixtures thereof, and the like. Exemplary styrenic thermoplastic elastomers include triblock styrenic block copolymers (SBC) such as styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof. Commercial examples include some grades of Kraton™ and Hybrar™ resins.

In an embodiment, at least one of the closure or the container may include a polyolefin polymer. A typical polyolefin may include a homopolymer, a copolymer, a terpolymer, an alloy, or any combination thereof formed from a monomer, such as ethylene, propylene, butene, pentene, methyl pentene, hexene, octene, or any combination thereof. In an embodiment, the polyolefin polymer may be copolymers of ethylene with propylene or alpha-olefins or copolymers of polypropylene with ethylene or alpha-olefins made by a metallocene or non-metallocene polymerization processes. Commercial polyolefin examples include Affinity™, Engage™, Flexomer™, Versify™, Infuse™, Exact™, Vistamaxx™, Softel™ and Tafmer™, Notio™ produced by Dow, ExxonMobil, Londel-Basell and Mitsui. In an embodiment, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA), and butyl acrylate (EBA). Exemplary suppliers of these ethylene copolymer resins include DuPont, Dow Chemical, Mitusi, and Arkema, etc. In another embodiment, the polyolefin polymer can be a terpolymer of ethylene, maleic anhydride, and acrylates such as Lotader™ made by Arkema and Evalloy™ produced by DuPont. In yet another embodiment, the polyolefin polymer can be an ionomer of ethylene and acrylic acid or methacrylic acid such as Surlyn™ made by DuPont. In an embodiment, the polyolefin is a reactor grade thermoplastic polyolefin polymer, such as P6E2A-005B available from Flint Hills Resources. In very particular embodiments, the thermoplastic tube can include a C-FLEX® brand biopharmaceutical tubing (available from Saint-Gobain Performance Plastics Corporation at Clearwater, Fla., USA. In an embodiment, at least one of the closure or the container may include, but are not limited to, thermoplastic, thermosets, fluoropolymers, and combinations thereof. Specific examples of suitable polymer material can be polyvinyldiene fluoride (PVDF). In an embodiment, at least one of the closure or the container can be formed of a thermoplastic elastomer, silicone, or combinations thereof. For example, specific types of thermoplastic elastomers can be those described in U.S. Patent Application Publication No. 2011/0241262, which is incorporated herein by reference, in its entirety, for all useful purposes.

In an embodiment, at least one of the closure or the container may include a fluorinated polymer. In an embodiment, at least one of the closure or the container may include a polymer including at least one of polytetrafluoroethylene (PTFE), modified polytetrafluoroethylene (mPTFE), ethylene-tetrafluoroethylene (ETFE), perfluoroalkoxy ethylene (PFA), tetrafluoroethylene-hexafluoropropylene (FEP), tetrafluoro-ethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulfone (PES), polyphenylene sulfone ($PPSO_2$), liquid crystal polymers (LCP), polyetherketone (PEK), polyether ether ketones (PEEK), aromatic polyesters (Ekonol), of polyether-ether-ketone (PEEK), polyetherketone (PEK), liquid crystal polymer (LCP), polyamide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, polyvinylidene chloride, aliphatic polyketone, liquid crystalline polymers, ethylene methyl acrylate copolymer, ethylene-norbomene copolymers, polymethylpentene and ethylene acrylic acid copolymer, mixtures, copolymers and any combination thereof. In a specific embodiment, at least one of the closure or the container may include a perfluoroalkoxy alkane (PFA).

In an embodiment, at least one of the closure or the container may include a metal or metal alloy. In an embodiment, the metal may be aluminum, iron, tin, platinum, titanium, magnesium, alloys thereof, or maybe a different metal. Further, the metal can include steel. The steel can include stainless steel, such as austenitic stainless steel. Moreover, the steel can include stainless steel including chrome, nickel, or a combination thereof. For example, the steel can X10CrNi18-8 stainless steel.

Further, in an embodiment, at least one of the closure or the container can include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

In an embodiment, at least one of the closure or the container can be formed as a single piece or may be formed as multiple pieces. In an embodiment, at least one of the closure or the container can be a molded component. In an embodiment, at least one of the closure or the container can be formed through over-molding or other methods known in the art. In an embodiment, the polymer or polymeric blend included in at least one of the closure or the container may be processed by any known method to form the polymeric mixture. The polymer or polymeric blend may be melt processed by dry blending or compounding. The dry blend may be in powder, granular, or pellet form. The blend can be made by a continuous twin-screw compounding process or batch-related Banbury process. Pellets of these mixtures may then be fed into a single screw extruder to make articles such as flexible tubing products. Mixtures can also be mixed in a single-screw extruder equipped with mixing elements and then extruded directly into articles such as tubing products. In a particular embodiment, the mixture can be melt processed by any method envisioned known in the art such as laminating, casting, molding, extruding, and the like. In an embodiment, the mixture can be injection molded.

In an embodiment, the polymer or polymeric blend can advantageously withstand sterilization processes. In an embodiment, the polymer or polymeric blend may be sterilized by any method envisioned. For instance, the polymer or polymeric blend is sterilized after at least one of the closure or the container is formed. Exemplary sterilization methods include steam, gamma, ethylene oxide, E-beam techniques, combinations thereof, and the like. In a particular embodiment, the polymer or polymeric blend is sterilized by gamma irradiation. For instance, the polymer or polymeric blend of at least one of the closure or the container may be gamma sterilized at between about 25 kGy to about 55 kGy. In a particular embodiment, the polymer or polymeric blend is sterilized by steam sterilization. In an exemplary embodiment, the polymer or polymeric blend is heat-resistant to steam sterilization at temperatures up to about 130° C. for a time of up to about 45 minutes. In an embodiment, the polymer or polymeric blend is heat resistant to steam sterilization at temperatures of up to about 135° C. for a time of up to about 15 minutes. In an exemplary embodiment, the polymer or polymeric blend of the closure 200 or the container 270 may not bind to glutaraldehyde, making the closure easier to open for a user without the use of tools in a sterile environment.

In an embodiment, the polymer or polymeric blend of at least one of the closure or the container may be formed into a single layer article, a multi-layer article, or can be laminated, coated, or formed on a substrate to form at least one of the closure or the container. Multi-layer articles may include layers such as reinforcing layers, adhesive layers, barrier layers, chemically resistant layers, metal layers, any combination thereof, and the like. The polymer or polymeric blend can be formed into any useful shape such as film, sheet, tubing, and the like to form at least one of the closure or the container.

In an embodiment, at least one of the closure or the container may have further desirable physical and mechanical properties. For instance, at least one of the closure or the container may appear transparent or at least translucent. For instance, at least one of the closure or the container may have a light transmission greater than about 2%, or greater than about 5% in the visible light wavelength range. In particular, the resulting articles have desirable clarity or translucency. In addition, at least one of the closure or the container has advantageous physical properties, such as a balance of any one or more of the properties of hardness, flexibility, surface lubricity, spallation, fouling, tensile strength, elongation, Shore A hardness, gamma resistance, weld strength, and seal integrity to an optimum level.

In an embodiment, at least one of the closure or the container may have desirable heat stability properties. In a particular embodiment, at least one of the closure or the container has one more of the following heat resistance properties such as a higher burst resistance, a higher softening point, and/or a higher autoclaving temperature compared to currently available commercial products. Applications for the polymer or polymeric blend are numerous. In particular, the polymer or polymeric blend is non-toxic, making the material useful for any application where no toxicity is desired. For example, the polymer or polymeric blend may be substantially free of plasticizers or other low-molecular weight extenders that can be leached into the fluids it transfers. "Substantially free" as used herein refers to a polymeric mixture having a total organics content (TOC) (measured in accordance to ISO 15705 and EPA 410.4) of less than about 100 ppm. Further, the polymer or polymeric blend has biocompatibility and animal-derived component-free formulation ingredients. For instance, the polymeric mixture has potential for FDA, USP, EP, ISO, and other regulatory approvals. In an exemplary embodiment, the polymer or polymeric blend may be used in applications such as industrial, medical, health care, biopharmaceutical, pharmaceutical, drinking water, food & beverage, laboratory, dairy, and the like. In an embodiment, the polymeric mixture may be used in applications where low-temperature resistance is desired. In an embodiment, the polymer or polymeric blend may also be safely disposed as it generates substantially no toxic gases when incinerated and leaches no plasticizers into the environment if landfilled.

In particular embodiments, closure 200 may be removable from the container 270 to form an "open position." In particular embodiments, closure 200 may be removable from the container 270 to form an open position upon application of torsional force of no greater than about 25 N-m, no greater than about 20 N-m, no greater than about 15 N-m, no greater than about 10 N-m, no greater than about 9 N-m, no greater than about 8 N-m, no greater than about 7 N-m, no greater than about 6 N-m, or no greater than about 5 N in a direction generally parallel to the central axis 290. In this regard, the bearings 300, 302 can provide an effective resistance to radial movement while permitting axial translation of the posts 100, 102 upon application of a minimal longitudinal force.

A method may be used for forming a closed container according to a number of embodiments. The method may include a first step including providing a container having a generally annular neck defining a container opening having a central axis, the neck having a top edge and inner and outer surfaces. The method may include a second step of providing a closure including: an annular top wall having opposed inner and outer surfaces; a generally annular skirt extending downwardly from the inner surface of the top wall, the generally annular skirt having opposed outer and inner surfaces, the inner surface of the generally annular skirt adapted to engage the outer surface of the neck of the container; and an elastic annular seal member extending downwardly from an inner surface of the top wall, the annular seal member adapted to engage the inner surface of the neck of the container, where the elastic annular seal member includes an inner surface, an outer surface, and an apex, where the outer surface of the elastic seal member is generally parallel to the central axis, and where the inner surface of the elastic seal member includes a first section generally parallel to the central axis, and a second section tapered outwardly to meet the outer surface at the apex. The method may include a third step of disposing the closure over the neck of the container such that the inner surface of the closure seals against the outer surface of the neck of the container, and the outer surface of the annular seal member seals against the inner surface of the neck of the container.

Use of the closure or closure and container system may provide increased benefits in several applications in fields such as, but not limited to, industrial, medical, health care, biopharmaceutical, pharmaceutical, drinking water, food & beverage, laboratory, dairy, or other types of applications. Notably, the use of the closure or closure and container system may provide a sealing mechanism for housing a product meant for sterilization, such as a medical device, pharmaceutical product, or biological product (e.g., a heart) used in a surgical procedure. Further, the use of the closure or closure and container system may provide a sealing mechanism that provides ease of transition from a closed position to an open position to remove the product without the use of any tools. This may provide optimal sealing engagement while allowing improved ease of use in difficult environments, such as operating rooms, hospitals, or pharmacies.

Many different aspects and embodiments are possible. Some of those aspects and embodiments are described below. After reading this specification, skilled artisans will appreciate that those aspects and embodiments are only illustrative and do not limit the scope of the present invention.

Embodiment 1: A closure for a container having a generally annular neck defining a container opening having a central axis, the neck having a top edge and inner and outer surfaces, the closure comprising: an annular top wall having opposed inner and outer surfaces; a generally annular skirt extending downwardly from the inner surface of the top wall, the generally annular skirt having opposed outer and inner surfaces, the inner surface of the generally annular skirt adapted to engage the outer surface of the neck of the container; and an elastic annular seal member extending downwardly from an inner surface of the top wall, the annular seal member adapted to engage the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex.

Embodiment 2: A combination container and closure system comprising: a container having a generally annular neck defining a container opening having a central axis, the neck having a top edge and inner and outer surfaces; and a closure comprising: an annular top wall having opposed inner and outer surfaces; a generally annular skirt extending downwardly from the inner surface of the top wall, the generally annular skirt having opposed outer and inner surfaces, the inner surface of the generally annular skirt engaging the outer surface of the neck of the container; and an elastic annular seal member extending downwardly from an inner surface of the top wall, the annular seal member engaging the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex.

Embodiment 3: A method for forming a closed container, comprising: providing a container having a generally annular neck defining a container opening having a central axis, the neck having a top edge and inner and outer surfaces; providing a closure comprising: an annular top wall having opposed inner and outer surfaces; a generally annular skirt extending downwardly from the inner surface of the top wall, the generally annular skirt having opposed outer and inner surfaces, the inner surface of the generally annular skirt adapted to engage the outer surface of the neck of the container; and an elastic annular seal member extending downwardly from an inner surface of the top wall, the annular seal member adapted to engage the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex; and disposing the closure over the neck of the container such that the inner surface of the closure seals against the outer surface of the neck of the container, and the outer surface of the annular seal member seals against the inner surface of the neck of the container.

Embodiment 4: The closure, combination container and closure system, or method of any of the preceding embodiments, wherein the container or closure comprises a fluorinated polymer.

Embodiment 5: The closure, combination container and closure system, or method of embodiment 4, wherein the container or closure comprises a perfluoroalkoxy alkane.

Embodiment 6: The closure, combination container and closure system, or method of any of the preceding embodiments, wherein the outer surface of the neck of the container comprises a plurality of threadings.

Embodiment 7: The closure, combination container and closure system, or method of any of the preceding embodiments, wherein the inner surface of the closure comprises a plurality of threadings.

Embodiment 8: The closure, combination container and closure system, or method of embodiment 7, wherein the threadings on the inner surface of the closure couple to the threadings on the outer surface of the neck of the container.

Embodiment 9: The closure, combination container and closure system, or method of any of the preceding embodiments, wherein the inner surface of the generally annular skirt of the closure comprises a step.

Embodiment 10: The closure, combination container and closure system, or method of embodiment 9, wherein the step defines a distance, $D_1$, from the inner surface of the annular top wall of the closure, wherein an end of the first section of the inner surface of the elastic seal member defines a distance, $D_2$, from the inner surface of the annular top wall of the closure, and wherein $D_1 \approx 0.9\ D_2$.

Embodiment 11: The closure, combination container and closure system, or method of any of the preceding embodiments, wherein the inner surface of the neck of the container comprises a step.

Embodiment 12: The closure, combination container and closure system, or method of any of the preceding embodiments, wherein the outer surface of the neck of the container comprises a step.

Embodiment 13: The closure, combination container and closure system, or method of embodiment 12, wherein the step of an inner surface of the neck of the container defines a distance, $T_1$, from the top edge of the neck to the step of the inner surface of the neck, wherein the step of an outer surface of the neck of the container defines a distance, $T_2$, from the top edge of the neck to the step of the outer surface of the neck, and wherein $T_1 \geq T_2$.

Embodiment 14: The closure, combination container and closure system, or method of embodiment 12, wherein the neck of the container is rounded above the step of the outer surface of the neck of the container.

Embodiment 15: The closure, combination container and closure system, or method of embodiment 12, wherein the inner surface of the neck of the container is tapered inwardly above the step of the inner surface of the neck of the container.

Embodiment 16: The closure, combination container and closure system, or method of any of the preceding embodiments, wherein the top edge of the container is rounded above the step of the outer surface of the neck of the container.

Embodiment 17: The closure, combination container and closure system, or method of any of the preceding embodiments, wherein the outer surface of the neck of the container is tapered outwardly above the step of the outer surface of the neck of the container.

Embodiment 18: The closure, combination container and closure system, or method of any of the preceding embodiments, wherein the closure is removable from the container upon application of force of no greater than 25-30 in-lbf.

Embodiment 19: The closure, combination container and closure system, or method of any of the preceding embodiments, wherein the elastic annular seal member of the closure contacts the inner surface of the neck of the container along 60% of its length, such as along 70% of its length, 80% of its length, 90% of its length, or 100% of its length.

Embodiment 20: The closure, combination container and closure system, or method of any of the preceding embodiments, wherein at least one of the closure or container is capable of maintaining sterilization upon closure.

Embodiment 21: The closure, combination container and closure system, or method of any of the preceding embodiments, wherein the container is capable of housing a biological product or medical device.

Embodiment 22: The closure, combination container and closure system, or method of any of the preceding embodiments, wherein at least one of the closure or container does not bond to glutaraldehyde.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

Note that not all of the activities described above in the general description or the examples are required, that a portion of a specific activity may not be required, and that one or more further activities may be performed in addition to those described. Still further, the order in which activities are listed are not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed:

1. A closure for a container having a generally annular neck defining a container opening having a central axis, the neck having a top edge and inner and outer surfaces, the closure comprising:

an annular top wall having opposed inner and outer surfaces;

a generally annular skirt extending downwardly from the inner surface of the top wall, the generally annular skirt having opposed outer and inner surfaces, the inner surface of the generally annular skirt adapted to engage the outer surface of the neck of the container; and an elastic annular seal member extending downwardly from an inner surface of the top wall, the annular seal member adapted to engage the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex, wherein the second section comprises a width and wherein the second section is tapered outwardly along the entirety of the width of the second section.

2. A combination container and closure system comprising:

a container having a generally annular neck defining a container opening having a central axis, the neck having a top edge and inner and outer surfaces; and a closure comprising:

an annular top wall having opposed inner and outer surfaces;

a generally annular skirt extending downwardly from the inner surface of the top wall, the generally annular skirt having opposed outer and inner surfaces, the inner surface of the generally annular skirt engaging the outer surface of the neck of the container; and an elastic annular seal member extending downwardly from an inner surface of the top wall, the annular seal member engaging the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex, wherein the second section comprises a width and wherein the second section is tapered outwardly along the entirety of the width of the second section.

3. A method for forming a closed container, comprising:

providing a container having a generally annular neck defining a container opening having a central axis, the neck having a top edge and inner and outer surfaces;

providing a closure comprising: an annular top wall having opposed inner and outer surfaces; a generally annular skirt extending downwardly from the inner surface of the top wall, the generally annular skirt having opposed outer and inner surfaces, the inner surface of the generally annular skirt adapted to engage the outer surface of the neck of the container; and an elastic annular seal member extending downwardly from an inner surface of the top wall, the annular seal member adapted to engage the inner surface of the neck of the container, wherein the elastic annular seal member comprises an inner surface, an outer surface, and an apex, wherein the outer surface of the elastic seal member is generally parallel to the central axis, and wherein the inner surface of the elastic seal member comprises a first section generally parallel to the central axis, and a second section tapered outwardly to meet the outer surface at the apex; and disposing the closure over the neck of the container such that the inner surface of the closure seals against the outer surface of the neck of the container, and the outer surface of the annular seal member seals against the inner surface of the neck of the container, wherein the second seciton comprises a width and wherein the second section is tapered outwardly along the entirety of the width of the second section.

4. The closure of claim 1, wherein the closure comprises a fluorinated polymer.

5. The closure of claim 4, wherein the closure comprises a perfluoroalkoxy alkane.

6. The combination container and closure system of claim 2, wherein the outer surface of the neck of the container comprises a plurality of threadings.

7. The closure of claim 1, wherein the inner surface of the closure comprises a plurality of threadings.

8. The closure of claim 7, wherein the threadings on the inner surface of the closure couple to the threadings on the outer surface of the neck of the container.

9. The closure of claim 1, wherein the inner surface of the generally annular skirt of the closure comprises a step.

10. The closure of claim 9, wherein the step defines a distance, $D_1$, from the inner surface of the annular top wall of the closure, wherein an end of the first section of the inner surface of the elastic seal member defines a distance, $D_2$, from the inner surface of the annular top wall of the closure, and wherein $D_1 \approx 0.9\ D_2$.

11. The combination container and closure system of claim 2, wherein the inner surface of the neck of the container comprises a step.

12. The combination container and closure system of claim 2, wherein the outer surface of the neck of the container comprises a step.

13. The combination container and closure system of claim 12, wherein the step of the inner surface of the neck of the container defines a distance, $T_1$, from the top edge of the neck to the step of the inner surface of the neck, wherein the step of the outer surface of the neck of the container defines a distance, $T_2$, from the top edge of the neck to the step of the outer surface of the neck, and wherein $T_1 \geq T_2$.

14. The combination container and closure system of claim 12, wherein the neck of the container is rounded above the step of the inner surface of the neck of the container.

15. The combination container and closure system of claim 12, wherein the inner surface of the neck of the container is tapered inwardly above the step of the inner surface of the neck of the container.

16. The combination container and closure system of claim 2, wherein the top edge of the container is rounded above the step of the outer surface of the neck of the container.

17. The combination container and closure system of claim 2, wherein the outer surface of the neck of the container is tapered outwardly above the step of the outer surface of the neck of the container.

18. The closure of claim 1, wherein the closure is removable from the container upon application of force of no greater than 25-30 in-lbf.

19. The combination container and closure system of claim 2, wherein the elastic annular seal member of the closure contacts the inner surface of the neck of the container along 60% of its length.

20. The combination container and closure system of claim 2, wherein at least one of the closure or container is capable of maintaining sterilization upon closure.

* * * * *